US005517214A

United States Patent [19]

Bhatia et al.

[11] Patent Number: 5,517,214

[45] Date of Patent: May 14, 1996

[54] INK JET IMAGE DRIER

[75] Inventors: Chandrakant R. Bhatia, Libertyville; Steven S. Kuhlin, Lake Zurich, both of Ill.

[73] Assignee: A.B. Dick Company, Niles, Ill.

[21] Appl. No.: 94,457

[22] Filed: Jul. 20, 1993

[51] Int. Cl.[6] ..... B41J 2/01; B41F 23/04

[52] U.S. Cl. ..... 346/25; 347/4; 347/102; 101/424.1

[58] Field of Search ..... 346/25; 347/102, 347/4, 2; 101/416.1, 424.1, 487, 488; 239/562, 566, DIG. 21; 34/104, 105, 106, 437, 438, 439

[56] References Cited

U.S. PATENT DOCUMENTS

| | | | |
|---|---|---|---|
| 4,340,893 | 7/1982 | Ort | 346/25 |
| 4,774,523 | 9/1988 | Beaufort et al. | 347/102 |
| 5,173,988 | 12/1992 | Bhatia et al. | 15/309.2 |

FOREIGN PATENT DOCUMENTS

| | | |
|---|---|---|
| 0049233 | 4/1982 | European Pat. Off. . |
| 0080448 | 6/1983 | European Pat. Off. . |
| 0364425 | 4/1990 | European Pat. Off. . |
| 2536516 | 5/1984 | France . |
| 3707860 | 10/1988 | Germany . |
| 4021227 | 6/1991 | Germany . |

OTHER PUBLICATIONS

Gardner, T. A., "High Speed and Drying"; Printing Magazine/National Lithographer; vol. 87, No. 10; Oct. 1963; pp. 116–117, 136.

*Primary Examiner*—Benjamin R. Fuller
*Assistant Examiner*—Alrick Bobb
*Attorney, Agent, or Firm*—Rockey, Rifkin & Ryther

[57] ABSTRACT

The drier consists of a plurality of nozzles that direct a small volume of air onto the printed image at as high a velocity as possible without disturbing the wet image. The air so delivered while it must be dry, does not have to be heated to effectively dry the image, however, the drying time can be reduced by increasing the air temperature if desired. The use of high velocity air creates what is known is "skin effect" to dry the ink where the outer surface of the ink is quickly dried.

17 Claims, 3 Drawing Sheets

INK JET IMAGE DRIER

BACKGROUND OF THE INVENTION

The invention relates, generally, to ink jet printers and, more particularly, to an improved device for drying the ink image.

Ink jet printers are used in a wide variety of printing applications. One such application is the printing of images such as expiration dates and lot numbers on cans, bottles and the like on high speed automated conveyor lines. Typically, the cans or bottles are filled with product, capped and labelled. The labelling process includes the application of the ink jet images directly to the cans and bottles and/or the labelling therefor. Because the ink jet imaging process occurs as part of the high speed operation, it must be carried out rapidly and efficiently where the images are applied and dried for further handling in a matter of seconds.

The ink jet printers used in these high speed applications typically include an ink jet nozzle having an orifice providing a stream of ink. A piezoelectric device surrounds and acts upon the nozzle to cause the formation of drops as the ink leaves the nozzle orifice. The drops are selectively charged by a charging electrode and pass through a deflection field. The deflection field is created by opposed upper and lower electrodes where one electrode is connected to a power supply and the other electrode is grounded or connected to a power supply of opposite polarity. The deflection field deflects selected drops to cause them to strike the substrate being marked, i.e. the can or bottle, to create a desired image. The drops that are not deflected to the substrate are caught by an ink catcher that returns the drops to the ink system for reuse. Typical ink jet printers are disclosed in U.S. Pat. No. 4,845,512 issued to Arway and U.S. Pat. No. 5,196,860 issued to Pickell et al.

As will be apparent, the ink drops applied to the can, bottle or paper will be wet immediately after application. Because ink jet printers are used in high speed applications the wet ink presents handling problems in that the wet ink can be easily smeared or smudged. Thus, it is desired to dry the ink drops after the can, bottle or paper has left the printer.

Known driers typically consist of a heating element and blower positioned downstream of the printing station. The blower forces air over the heating element and onto the newly printed image. The blowers used in this process typically move the air at low pressure and high volume, i.e. on the order of 100–200 cubic feet per minute, to transfer heat to the printed image by convection and/or radiation.

This process utilizes a large amount of air and electrical energy and is relatively inefficient and slow. As a result, the operating cost of the drier is high. Because a large volume of hot air is used, the metal components found in the production line are exposed to the heated air and become extremely hot resulting in a safety hazard. Moreover, if the line stops for any reason the stationary product in front of the heater radiating heat is heated to a level that could damage the product or in the case of paper could start a fire. Finally, the blowers used in this process are large and noisy.

Thus, a safer, less expensive and more efficient ink jet image drier is desired.

SUMMARY OF THE INVENTION

The drier of the invention consists of a plurality of nozzles that direct a small volume of air onto the printed image at a high velocity. The air velocity is maintained as high as possible without disturbing the wet ink image. The specially designed nozzles of the invention allow the air to be delivered to the printed image area without warming the entire area. The air so delivered, while it must be dry, does not have to be heated to effectively dry the image; however, the drying time can be reduced by increasing the air temperature if desired. The use of high velocity air creates what is known as "skin effect" where the outer surface of the ink is quickly dried such that the ink image can be handled thereafter.

DETAILED DESCRIPTION OF A PREFERRED EMBODIMENT OF THE INVENTION

Figure 1:
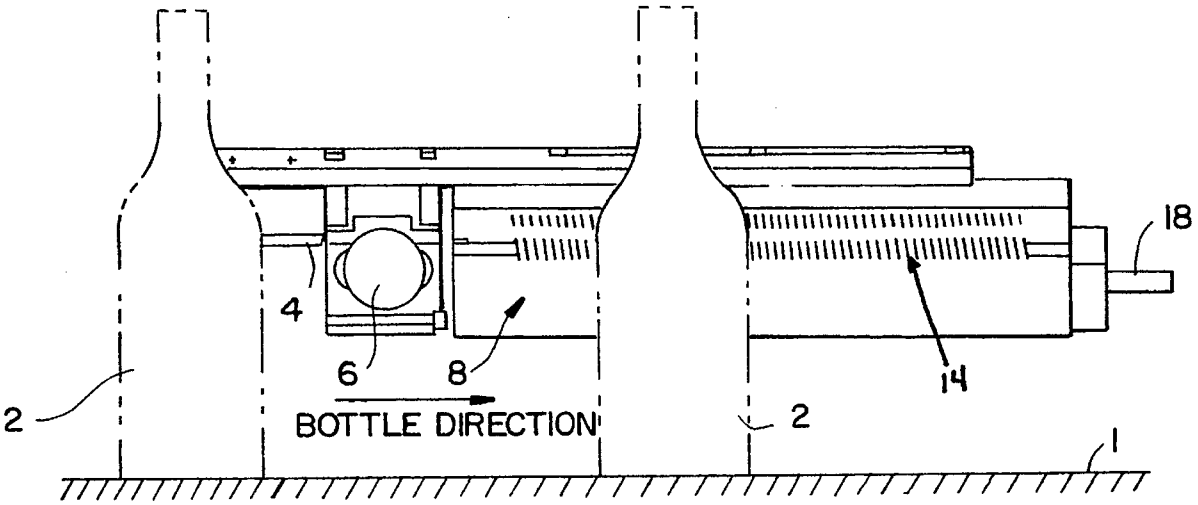
FIG. 1 is a front view of the drier of the invention used on a high speed line.
Figure 2:
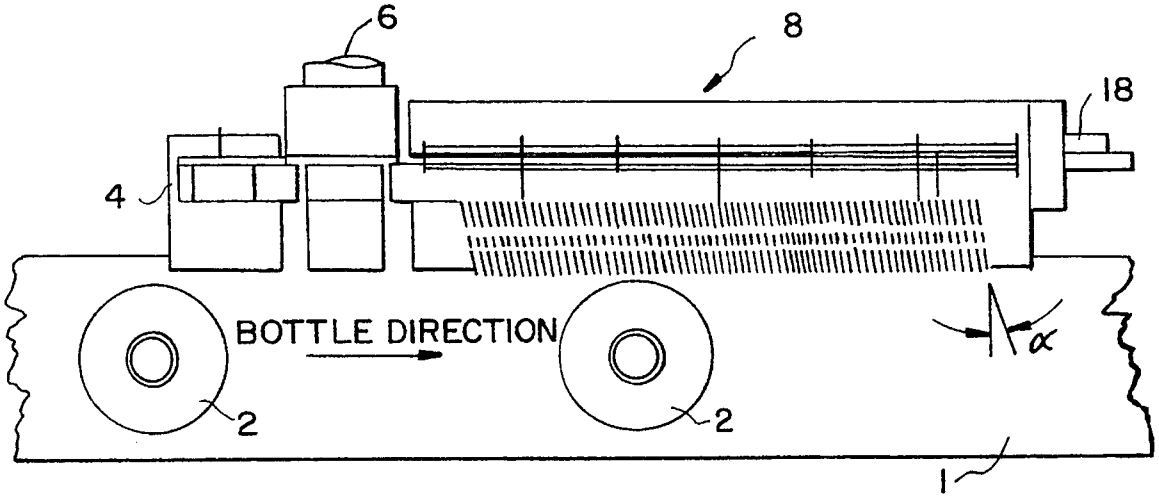
FIG. 2 is a top view of the drier of the invention on a high speed line.

Referring more particularly to FIGS. 1 and 2, the ink jet printer section of a bottle filling production line is shown. The production line consists of a conveyor 1 for moving bottles 2 at high speed. While the illustrated embodiment of the invention shows a bottle fill line it will be appreciated that the drier could be used with any substrate on which ink is printed such as cans, cartons, packaging and the like. Typically the conveyor 1 moves at a speed of 100–200 feet per minute or more such that 600 bottles per minute are handled. As the bottles move into the ink jet printer section they are dewatered (moisture may be due to condensation and cleaning or filling operations) by a dewatering device 4 such as that disclosed in U.S. Pat. No. 5,173,988 issued to Bhatia. The dewatering device creates a clean, warm, dry surface on which the ink jet printer is to print an image.

Immediately after leaving the dewatering device 4, the bottles pass ink jet printer printhead 6. The print head applies the desired ink image to the bottles as has been previously described.

Figure 3:
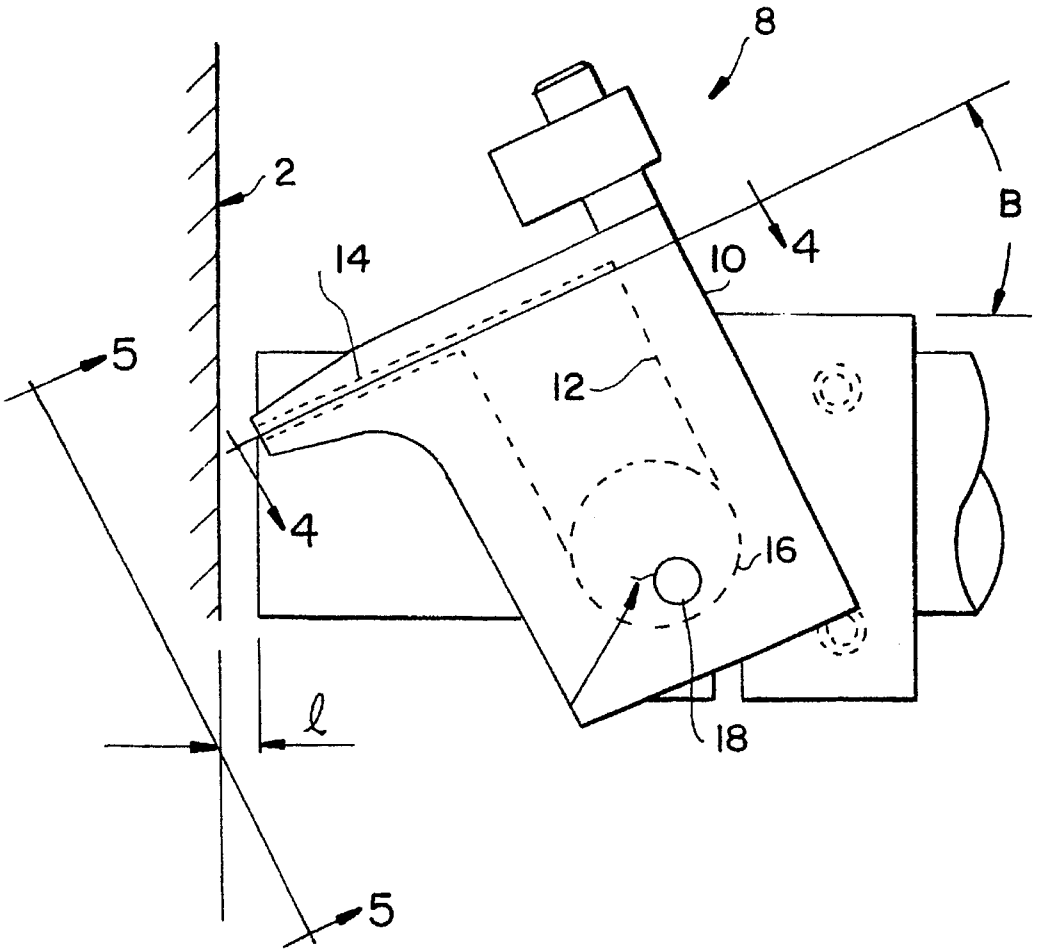
FIG. 3 is an end view of the drier of the invention on a high speed line.
Figure 4:
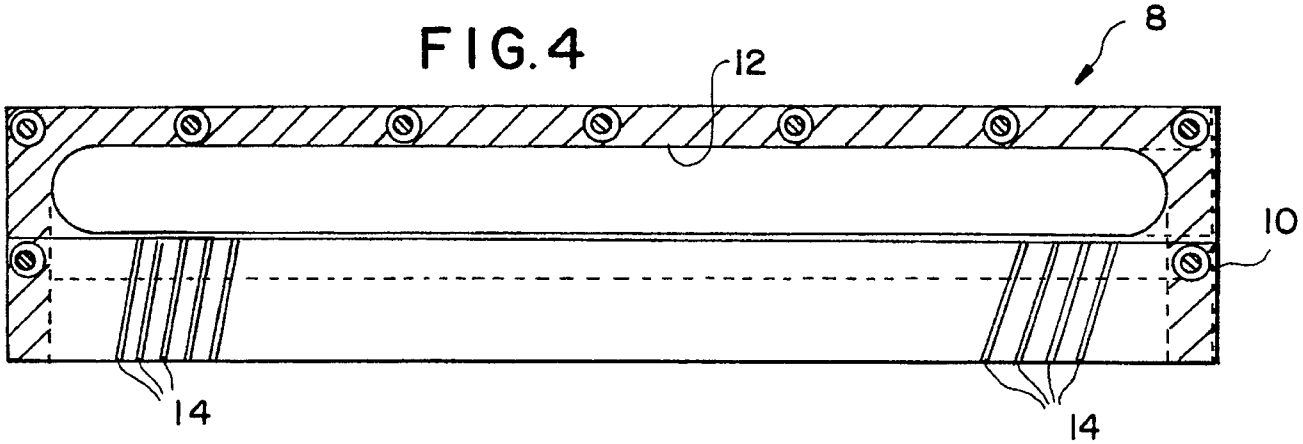
FIG. 4 is a section view taken along line 4—4 of FIG. 3.
Figure 5:
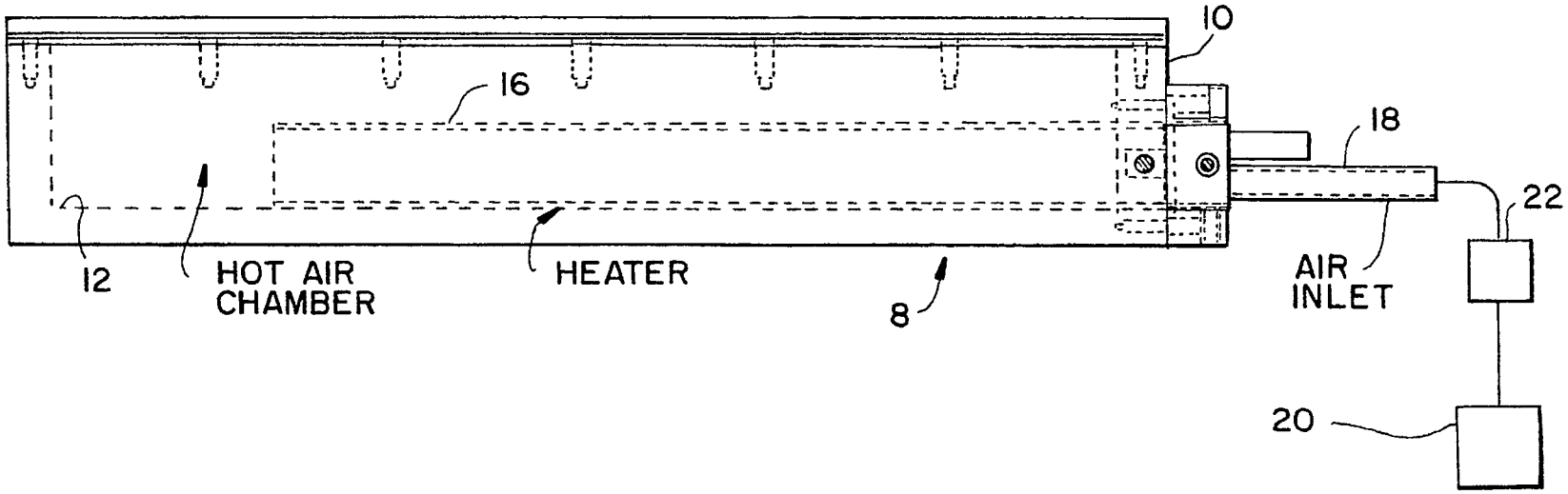
FIG. 5 is a view taken along line 5—5 of FIG. 3.

The bottles with the wet ink jet image thereon then immediately pass the drier 8 of the invention. Referring more particularly to FIGS. 3 through 5, the drier 8 consists of an air tight housing 10 defining a hot air chamber 12 therein. Chamber 12 communicates with a plurality of small air nozzles 14 such that air delivered to the chamber 12 under pressure will exit via nozzles 14 at high speed. The nozzles 14 are disposed along the entire length of drier 8 such that the bottles will be contacted by the air for the length of drier 8 as they are moved by conveyor 1.

Located within chamber 12 is a heating element 16. Heating element 16 can consist of a coil or other controllable heater capable of heating the air in chamber 12 to a preferred temperature range of between 150° and 400° F. or higher. In the illustrated embodiment, the air is delivered to chamber 12 under pressure via air inlet line 18 where air inlet line is located such that the air passes through the interior of heating element 16 before entering chamber 12. Other suitable arrangements of the heating element and air inlet can be used provided the air is suitably heated. The air can be provided to air inlet 18 by a compressor 20 or other suitable air source.

Preferably a regulator 22 is provided to control the pressure and flow rate of the air delivered to inlet 18. In the preferred embodiment, the air pressure is maintained at between 20 and 50 psia and the air velocity leaving nozzles 14 is in the preferred range of 5,000 to 10,000 feet per minute. The drier of the invention moves a volume of air of approximately 5 cubic feet per minute. The velocity of the air is adjusted by regulating the air pressure in chamber 12 via regulator 22. It is desired to maintain the air velocity as high as possible to maximize drying without physically disturbing the ink drops on the surface. The specific maximum velocity of the air that can be used depends upon the type of ink, size of the drops and the type of substrate surface.

The use of high speed air creates a so-called "skin effect" where a dry layer of ink is quickly formed over the ink drop. This dry "skin" layer facilitates handling of the product by minimizing the smearing or smudging of the ink due to contact.

Although nozzles 14 can be arranged perpendicular or angled opposite to the direction of travel of the bottles, in the preferred embodiment they are angled as shown by angle $\alpha$ in FIG. 2 relative to a line perpendicular to the direction of travel of bottles 2. As a result when the bottles 2 pass parallel to drier 8 the air from the nozzles 14 will contact the bottle at angle $\alpha$. The angling of the nozzles provides a velocity component in the direction of travel of the bottles such that the time the air stream contacts the bottle is increased. The use of the angled nozzle also directs the air away from the printhead 6 to minimize any adverse effect of the air on the printing process.

Moreover, referring to FIG. 3, the drier is mounted such that the nozzles are also at a preferred angle of approximately 25 degrees relative to the horizontal as shown by angle B. The drier is angled to control the direction the air moves after hitting the bottle and, thereby, control the width of the area heated by the air such that the entire bottle is not heated. Finally, the nozzles are in the preferred embodiment spaced from the passing substrate approximately 0.19 to 0.25 inches for maximum results as shown at d in FIG. 3.

The speed of drying is affected by three factors: 1) the velocity of the air, 2) the time the ink is exposed to the air, and 3) the temperature differential between the ink and the air. As previously described, the air temperature and velocity can be controlled by controlling the heating element 16 and the pressure of the air via regulator 22.

The amount of time the ink is exposed to the air is dependent on two factors: 1) the length of drier 8 and 2) the speed at which the bottles are moved by conveyor 1. Because the conveyor speed is determined by the filling operation and cannot normally be altered, the time the ink is exposed to the air will depend on the length of the drier. The drier, in a preferred embodiment, is 11 inches long. The ink can be exposed to the air longer by increasing the length of the drier or by using additional driers arranged in series with the illustrated drier. Moreover, the angling of the nozzles 14 also increases the exposure time as previously described. Thus, the design of the drier of the invention enables the operator to control the three factors that control drying time quickly and easily to maximize the effectiveness of the system for each application.

While the invention has been described in some detail with reference to the figures, it will be appreciated that numerous changes in the details and construction of the device can be made without departing from the spirit and scope of the invention.

What is claimed is:

1. An ink printing system for applying an inked image to moving articles advancing in a downstream direction along a path, said system comprising:

a) a print head disposed adjacent said path for applying an inked image to said articles;

b) a de-watering device for removing water from said articles disposed adjacent said path and upstream from said print head;

c) a drier for drying said inked image disposed downstream of said print head and adjacent said path and including:

i) an air chamber to provide a supply of heated and pressurized air; and ii) a plurality of nozzles, communicating with said chamber, for directing said heated and pressurized air towards said inked image, each of said nozzles having an axis that forms an acute angle with said downstream direction and being configured to deliver said air at high velocity and low volume.

2. The device according to claim 1, wherein said nozzles are angled such that the air has a velocity component in said downstream direction whereby the air contacts the inked image for a longer period of time.

3. The device according to claim 2, wherein the nozzles are angled between 0 and 25 degrees to a line perpendicular to said downstream direction.

4. The device according to claim 1, wherein the nozzles are at an angle relative to the horizontal to control the direction the air moves after contacting the articles and thereby control a width of a heated area on said articles.

5. The device according to claim 4, wherein the nozzles are at an angle of approximately 25 degrees to the horizontal.

6. The device according to claim 1, wherein the velocity of the air is between 5,000 and 10,000 feet per minute.

7. The device according to claim 1, wherein the air is heated.

8. The device according to claim 7, wherein the air is heated to a temperature of between 100 and 600 degrees Fahrenheit.

9. The device according to claim 1, wherein the air is delivered to the nozzles under a pressure of between 5 and 60 psia.

10. The device according to claim 1, wherein a heating element is located in or outside said chamber.

11. The device according to claim 1, including means for regulating the pressure of the air delivered to the chamber thereby to control the speed of air from the nozzles.

12. The device according to claim 1, wherein the air creates a skin effect on the ink such that the outer surface of the drops is dried first.

13. The device according to claim 2, wherein the nozzles are angled away from the print head.

14. A device for drying ink jet images on a substrate moving in a travel direction comprising:

a) an air chamber;

b) a plurality of nozzles formed in said chamber for delivering air at high velocity and low volume, each of said nozzles having an axis that forms an acute angle with the direction of travel of the substrate;

c) the air chamber being mounted such that said delivered air has a velocity component at an angle with respect to horizontal;

d) means for delivering air under pressure to said chamber; and e) heating means for heating the air delivered from said nozzles.

15. An ink printing system for applying an inked image to moving articles advancing in a downstream direction along a path, said system comprising:

a) a print head disposed adjacent said path for applying an inked image to said articles;

b) a de-watering device for removing water from said articles disposed adjacent said path and upstream from said print head;

c) a drier for drying said inked image disposed downstream of said print head and adjacent said path and including:

i) an air chamber to provide a supply of heated and pressurized air; and ii) a plurality of nozzles, communicating with said chamber, for directing said heated and pressurized air towards said inked image, said nozzles being configured to deliver said air at high velocity and low volume, wherein said nozzles are angled between 0 and 25 degrees to a line perpendicular to said downstream direction such that said air has a velocity component in said downstream direction whereby said air contacts the inked image for a longer period of time.

16. An ink printing system for applying an inked image to moving articles advancing in a downstream direction along a path, said system comprising:

a) a print head disposed adjacent said path for applying an inked image to said articles;

b) a de-watering device for removing water from said articles disposed adjacent said path and upstream from said print head;

c) a drier for drying said inked image disposed downstream of said print head and adjacent said path and including:

i) an air chamber to provide a supply of heated and pressurized air; and ii) a plurality of nozzles, communicating with said chamber, for directing said heated and pressurized air towards said inked image, each of said nozzles having an axis that forms an acute angle with said downstream direction and being configured to deliver said air at high velocity and low volume, wherein the nozzles are angled relative to the horizontal to control the direction the air moves after contacting the articles and to thereby control a width of a heated area on said articles; and iii) means for delivering air under pressure to said chamber.

17. An ink printing system for applying an inked image to moving articles advancing in a downstream direction along a path, said system comprising:

a) a print head disposed adjacent said path for applying an inked image to said articles;

b) a de-watering device for removing water from said articles disposed adjacent said path and upstream from said print head;

c) a drier for drying said inked image disposed downstream of said print head and adjacent said path and including:

i) an air chamber to provide a supply of heated and pressurized air; and ii) a plurality of nozzles, communicating with said chamber, for directing said heated and pressurized air towards said inked image, each of said nozzles having an axis that forms an acute angle with said downstream direction and being configured to deliver said air at high velocity, low volume, and temperature wherein the air creates a skin effect on the ink such that the outer surface of the ink dries first; and iii) means for delivering heated air under pressure to said chamber.

* * * * *

UNITED STATES PATENT AND TRADEMARK OFFICE

CERTIFICATE OF CORRECTION

PATENT NO. : 5,517,214
DATED : May 14, 1996
INVENTOR(S) : Bhatia, et al.

It is certified that error appears in the above-indentified patent and that said Letters Patent is hereby corrected as shown below:

On the title page, section [73] "Assignee: A.B. Dick Company, Niles, Ill." should be --Assignee: Videojet Systems International, Inc., Wooddale, Ill.--.

Signed and Sealed this

Fifth Day of November, 1996

Bruce Lehman

*Attest:*

BRUCE LEHMAN

*Attesting Officer*

*Commissioner of Patents and Trademarks*